United States Patent [19]

Gross

[11] Patent Number: 4,802,773

[45] Date of Patent: Feb. 7, 1989

[54] BAG FOR MAIL AND THE LIKE

[75] Inventor: Clifford M. Gross, New York, N.Y.

[73] Assignee: Hospital For Joint Diseases Orthopedic Inst., New York, N.Y.

[21] Appl. No.: 948,446

[22] Filed: Dec. 30, 1986

Related U.S. Application Data

[63] Continuation of Ser. No. 638,626, Aug. 7, 1984.

[51] Int. Cl.[4] ..... B65D 33/06

[52] U.S. Cl. ..... 383/16; 383/7

[58] Field of Search ..... 383/16, 75, 6, 7; 220/94 A; 150/107

[56] References Cited

U.S. PATENT DOCUMENTS

| | | | |
|---|---|---|---|
| 55,416 | 6/1866 | Fye | 383/16 |
| 733,542 | 7/1903 | Converse | 383/16 |
| 1,233,784 | 4/1916 | Hutchinson | 383/16 |
| 2,616,467 | 11/1952 | Cicero | 383/16 |
| 2,761,480 | 9/1956 | Tames | 383/16 |
| 3,013,597 | 12/1961 | Moran | 383/75 |
| 3,409,063 | 11/1958 | Pokras | 383/16 |
| 3,599,690 | 8/1971 | Christie | 383/16 |
| 4,153,089 | 5/1979 | Veilleux | 383/16 |
| 4,153,146 | 5/1979 | Patton et al. | 383/16 |
| 4,480,774 | 11/1984 | Smith et al. | 383/16 |

FOREIGN PATENT DOCUMENTS

| | | | |
|---|---|---|---|
| 2306134 | 10/1976 | France | 383/16 |
| 1004540 | 3/1957 | Switzerland | 383/16 |

*Primary Examiner*—David T. Fidei

[57] ABSTRACT

A mail bag is fabricated from canvas sewn together to form a bag body with a closed bottom and open top adapted to be closed by a draw string. Three sets of handles, each also formed of pieces of canvas, are sewn to the outer surface of the bag. A first set of four handles are sewn to the bag spaced around the bag in a line proximate the top of the bag; while a second set of four handles are sewn to the bag spaced around the bag in a line proximate the bottom of the bag and so as to be parallel to and aligned with the first set of handles. A third set of four handles are sewn to the bag spaced around the bag aligned with the handles of the first and second sets but so that the handles of the third set midway between handles of the first and second sets and so that the disposition of the hanldes of said third set is either perpendicular to the disposition of the handles of said first and second sets; or parallel thereto.

2 Claims, 1 Drawing Sheet

BAG FOR MAIL AND THE LIKE

This application is a continuation of application Ser. No. 06/638,626, filed Aug. 7, 1984.

BACKGROUND OF THE INVENTION-FIELD OF APPLICATION

This invention relates to bags; and more particularly to bags for mail and the like.

BACKGROUND OF THE INVENTION-DESCRIPTION OF THE PRIOR ART

Bags, sacks and the like, formed from flexible material such as canvas, plastic, synthetic fabrics and similar materials, are often used as containers for a number of smaller items, or for bundles of smaller items, to facilitate storage and or shipment thereof. One such use that is quite common is for the shipment of mail whether it be bundles of letters, magazines, newspapers, parcels or the like, or combinations thereof.

Many of such bags are sewn together so that the bag has a bottom and a substantially circumferential body and is open at the top so that items can be placed inside the bag. A draw cord is often provided to close the top of the bag and some form of locking device may be provided to lock the cord so that the bag top remains closed. Alternative closing means for the top are also provided for some available bags.

Items are usually placed in such bags, or sacks, while the bag bottom is resting on the floor or on a table or other platform; or while the bag is positioned on a support that facilitates disposition of the bag with its top and body opened up to receive items. Once the bag has been either fully or partially filled, closed, and if desired secured in closed condition, the bag and its contents must be moved. Movement of the bag and contents may merely be to a stack of similar bags, or onto a truck, train or plane for shipment to another destination. Quite often the bag and its contents must be lifted, carried and set down a number of times before the contents are removed for further processing.

Many existing bags, or sacks, are not provided with handles of any sort whatsoever. Movement of such bags is often accomplished by dragging the bag on the floor by pulling on the draw cord. The party doing such dragging usually assumes an awkward position and the bag is disposed a distance from the person due to the length of the draw cord. The position thus assumed by the dragging person may result in strains, sprains, or at times serious injury to backs and other areas of the human anatomy. Sometimes the filled bag must be lifted and carried to facilitate its movement and/or to place the bag on a cart, truck, train or plane. The lack of handles on many such bags also makes lifting and subsequent carrying difficult and may also result in strain, sprain or other bodily injury to the lifting and carrying person.

To provide a mail bag with a number of handles such as shown in U.S. Pat. No. 55,416 patented on June 5, 1966 to J. Fye for Improved Mail Bag has not proved satisfactory for bags which must be either dragged and/or lifted and moved from place to place.

The fabrication of a bag with handles such as shown in U.S. Pat. No. 2,616,467 patented on Nov. 4, 1952 to W. Chicero for Sand bag; or as shown in U.S. Pat. No. 2,761,480 patented on Sept. 4, 1956 to D. Tomes for Laundry Bag also does not seem to provide the needed structure to facilitate the dragging and/or lifting and carrying of bags or sacks of the type used for mail or similar items. Similarly, providing bag structures and handle dispositions as shown in U.S. Pat. No. 3,019,952 patented on Feb. 6, 1962 to F. O. Brewster for Back Pack Convertible to Hand-Bag and in U.S. Pat. No. 3,797,650 patented on Mar. 19, 1974 to J. B. O'Brian et al for Show-Tote Bale Bag has not resolved the dragging, lifting and carrying problems experienced with available bags and sacks.

SUMMARY OF THE INVENTION

It is therefore an object of this invention to provide a new and improved bag.

It is another object of this invention to provide a new and improved bag for mail and the like.

It is still another object of this invention to provide a new and improved arrangement for handles on a bag.

It is yet still another object of this invention to provide a new and improved arrangement of handles for a bag for mail and the like.

It is a further object of this invention to provide a new and improved bag having handles secured thereto to facilitate dragging, lifting and carrying of the bag and its contents.

It is still a further object of this invention to provide a new and improved bag for mail and the like having an arrangement and disposition of handles to facilitate dragging, lifting and carrying of the mail bag and contents when mail is disposed therewithin.

Other objects, features and advantages of the invention in its details of construction and arrangement of parts will be seen from the above, from the following description of the preferred embodiment when considered with the drawing and from the appended claims. In addition, these and other objects and advantages of the present invention will become evident from the description which follows.

BRIEF DESCRIPTION OF THE INVENTION

This invention involves a bag or sack construction; and contemplates the attachment to the bag or sack of a plurality of handles secured to the bag at predetermined locations and in a predetermined disposition so that the weight of the bag and its contents will be closely proximate to the person dragging, lifting and/or carrying the bag and its contents, and so that strain on the persons spine and muscles are minimized.

The invention accordingly consists in the features of construction, combination of elements, and arrangement of parts which will be exemplified in the system, device, and article of manufacture hereinafter described, and of which the scope of application is as elucidated supra and as will be indicated in the appended claims. In this regard, numerous alternatives within the scope of the present invention besides those alternatives, preferred embodiments or modes of practicing the invention mentioned supra, and those to be elucidated, infra, will occur to those skilled in the art.

DESCRIPTION OF THE PREFERRED EMBODIMENT

For convenience the invention will be applied to a mail bag, or sack as it might be otherwise called, formed from canvas parts sewn together so that the mail bag has a closed bottom and a circumferential body open at the top. A draw cord, threaded through a channel formed at the top of the bag by folding over the material and sewing it in place, is secured in drawn condition closing the bag opening by a draw cord lock; and a number of handles also formed of canvas are sewn to the outside of the bag in a predetermined arrangement. It should be understood, nevertheless, that without departing from the invention that: the bag may be formed of plastic or other suitable flexible material; that the bag may be formed with side panels connected together to form a bag like enclosure open at the top; that means other than sewing can be used to secure the bag elements together to form the bag; that the bag top may be closed by means other than a draw cord and need not be locked in closed condition at all; that the handles may be formed from suitable materials and connected to the bag in any suitable and convenient manner.

Figure 1:
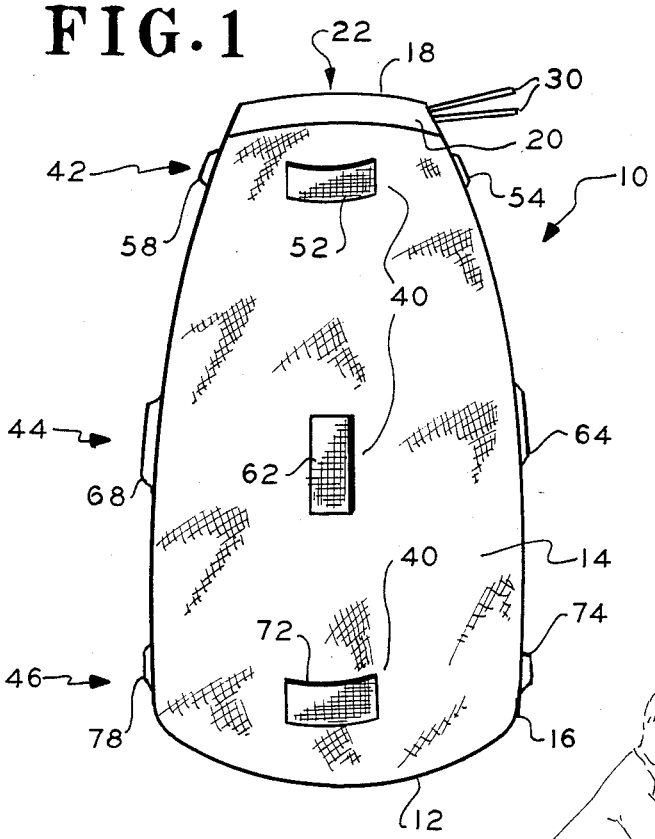
FIG. 1 is an elevational view of a mail bag, incorporating the instant invention.
Figure 2:
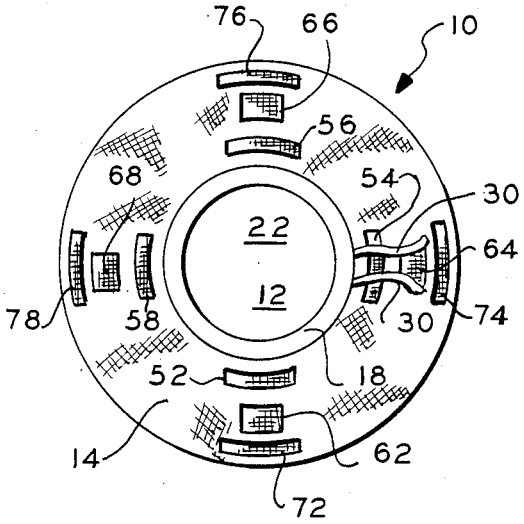
FIG. 2 is a top view of the mail bag of FIG. 1.

With reference to FIGS. 1 and 2, there is generally shown at 10 a bag, or sack, particularly fabricated and arranged to receive bundles of letters, magazines, brochures, packages and the like items of mail or similar items. Bag 10 is formed from a suitable grade of canvas and includes a bottom 12 (FIG. 1) and a body 14 generally cylindrical and circumferential in construction and having a lower edge 16 secured to bottom 12 as by sewing or other suitable means of attachment. An upper edge 18 of bag 10 is formed into a draw cord channel 20 by folding over a section of material and sewing or otherwise securing it in place. Bag 10 is thus formed with an opening 22 at the top thereof and through which items may be placed within bag 10.

A draw cord 30 is threaded through channel 20 and when drawn tight will close opening 22 so that items placed within bag 10 will not fall out. A draw cord lock, or securing means, of conventional construction cooperates with draw cord 30 to secure same in drawn condition and prevent opening 22 from opening up after it has been drawn closed.

A plurality of handles 40 are secured to the outer surface of bag 10. Handles 40 are fabricated from canvas which may be folded over or otherwise formed to provide a sturdy handle construction. Handles 40 are secured to the outer surface of bag 10 by sewing or other suitable means, such as rivets. Obviously, a combination of securing means, such as sewing and rivets, may be used to attach handles 40 to bag 10. Handles 40 are, however, arranged in predetermined locations and with a predetermined disposition, or alignment, on the outer surface of bag 10.

Handles 40 are arranged in three locations on bag 10, proximate the top 42, the middle 44 and the bottom 46 of bag 10. There are four handles 52, 54, 56 and 58 secured proximate top 42 of bag 10. There are four handles 62, 64, 66 and 68 secured proximate middle 44 of bag 10; and there are four handles 72, 74, 76 and 78 secured proximate bottom 46 of bag 10. Handles 52, 54, 56, 58, 72, 74, 76 and 78 are secured to bag 10 so that they are generally arranged to be parallel to upper edge of bag 10; while handles 62, 64, 66 and 68 for the embodiment shown are secured to bag 10 so that they are generally arranged to be perpendicular to the upper edge of bag 10. It should be understood, however, that handles 62, 64, 66 and 68 may just as well be disposed so as to be parallel to handles 52, 54, 56, 58, 72, 74, 76 and 78. The purpose of the arrangement of handles 40 on bag 10 will be hereinafter explained. While bag 10 is shown with four handles 40 each proximate the top 42, middle 44 and bottom 46 of bag 10 it should be understood that more handles in each such position may be used if desired and that less handles may be used except that at least two handles 40 should be placed in each such area to facilitate handling of bag 10 no matter how it happens to be placed on a floor; pile, or other support.

Figure 3:
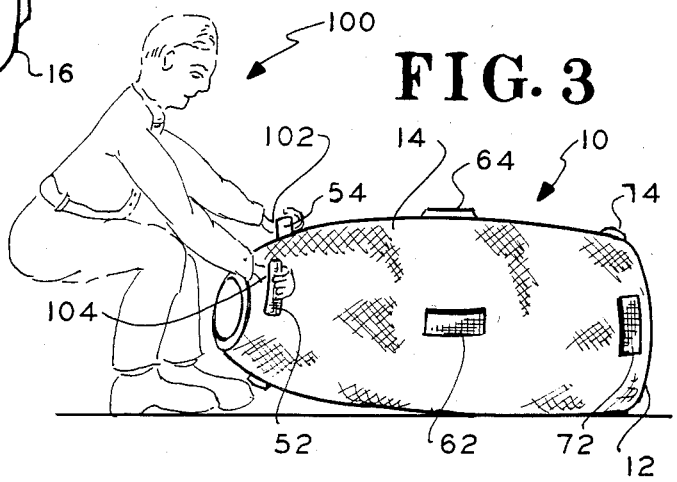
FIG. 3 is a schematic illustration of a person dragging the mail bag of FIGS. 1 and 2 after same has had a predetermined amount of mail placed therein.
Figure 4:
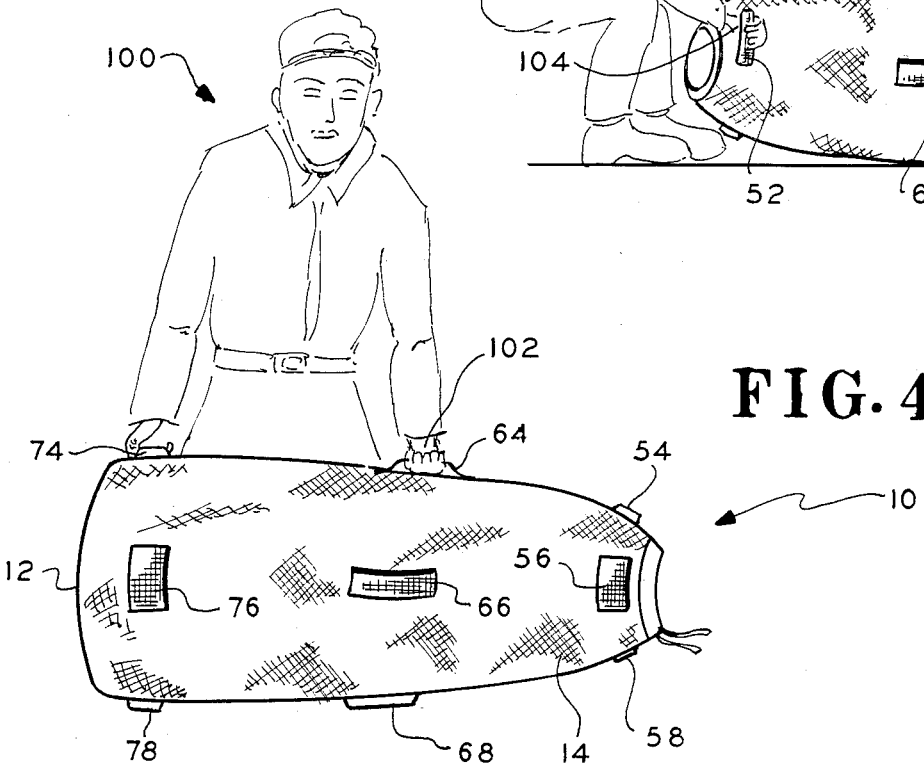
FIG. 4 is a schematic illustration of a person lifting the mail bag of FIGS. 1 and 2 after same has had a predetermined amount of mail placed therein.

Handles 52, 54, 56 and 58 arranged proximate top 42 of bag 10 are particularly disposed and arranged for dragging bag 10 along a floor, or other surface when bag 10 is either partially or fully loaded with items. The person 100 dragging bag 10 (FIG. 3) does so by grasping either one or two of handles 52, 54, 56 or 58 (depending upon which ones are available to be grasped). They do so with a power grip made by making a fist and preferably with their wrists 102 straight and wrist bottoms 104 facing upwardly. Person 100 should be as close to bag 10 as possible when dragging bag 10 and its contents to minimize moments on their spine and strain on other muscles required to move bag 10 and its contents. The arrangement and disposition of handles 52, 54, 56 and 58 facilitates this when dragging bag 10 and its contents.

Handles 62, 64, 66 and 68 arranged proximate middle 44 of bag 10 and handles 72, 74, 76 and 78 arranged proximate bottom 46 of bag 10 are particularly disposed and arranged to facilitate lifting and carrying bag 10 and its contents. When lifting bag 10 the person 100 grasps an available handle 62, 64, 66 or 68 with one hand and an aligned and available handle 72, 74, 76 or 78 with their other hand. By so grasping two such handles the weight of bag 10 and its contents are close to person 100 when lifting and carrying bag 10 and its contents. When doing so person 100's arms are almost vertical and this reduces the lifting moments on their back. The weight of the contents in bag 10 may not be uniformly disposed but by grasping two handles as described facilitates weight distribution.

From the above description, it will thus be seen that there has been provided a bag, or sack, for mail and other items that has secured thereto a plurality of handles disposed proximate the top, middle and bottom of the bag and otherwise arranged to facilitate dragging, lifting and/or carrying of the bag and its contents.

As various possible embodiments might be made of the above invention, and as various changes might be made in the embodiments above set forth, it is to be understood that all matter herein described or shown in the accompanying drawing is to be interpreted as illustrative and not in a limiting sense. Thus, it will be understood by those skilled in the art that although preferred and alternative embodiments have been shown and described in accordance with the Patent Statutes, the invention is not limited thereto or thereby, since the embodiments of the invention particularly disclosed and described herein above are presented merely as an example of the invention. Other embodiments, forms, and modifications of the invention, coming within the proper scope and spirit of the appended claims, will of course readily suggest themselves to those skilled in the art. Thus, while there has been described what is at present considered to be the preferred embodiments of the invention, it will thus be obvious to those skilled in the art that various changes and modifications may be made therein, without departing from the invention, and it is, therefore, aimed in the appended claims to cover all such changes and modifications as fall within the true spirit and scope of the invention, and it is understood that, although I have shown the preferred form of my invention, that various modifications may be made in the details thereof, without departing from the spirit as comprehended by the following claims.

What is claimed is:

1. A bag for mail and the like, said bag constructed with handles located for minimizing strain on the spine and muscles of a person lifting, carrying or dragging said bag and contents therein, said bag comprising:

(a) a bag body having a body portion in generally cylindrical configuration having an openable end and a closed end, a bottom portion secured to said cylindrical body portion for forming said closed end, said openable end for receiving items stored in said bag;

(b) a plurality of handles individually secured to said body portion in sets of pairs of handles, each handle of each pair of handles arcuately disposed about said body portion diametrically opposite a handle of the same set of pairs of handles, each handle of the same set of pairs spaced arcuately 90 degrees from the adjacent handles of the same set of pairs, said plurality of handles including, (c) a first set of pairs of handles secured to said body portion proximate said openable end;

(d) a second set of pairs of handles secured to said body portion proximate said closed end;

(e) a third set of pairs of handles secured to said body protion essentially equidistant between said first set of pairs and said second set of pairs, longitudinally;

(f) each handle of said first set of pairs of handles and each handle of said second set of pairs of handles secured to said body so that a circumferential line passing through the length of each handle of the same set of pairs of handles is at normal with the longitudinal axis passing through said generally cylindrical body and a longitudinal line passing through the length of a handle of said third set of pairs of handles is parallel with said longitudinal axis;

(g) one handle of said first set of pairs and one handle of said second set of pairs and one handle of said third set of pairs are essentially in alignment whereby a longitudinal line passing through the length of said one handle of said third set of pairs of handles is perpendicular to a circumferential line passing through the length of said one handle of said first set of pairs of handles and is perpendicular to a circumferential line passing through the length of said one handle of said second set of pairs of handles and the extension of said longitudinal line intersects each said circumferential line at approximately the midpoint of the handle through which the respective circumferential line passes; and, (h) said first set of pairs of handles being spaced from said third set of pairs of handles, longitudinally, a distance which substantially approximates the width of the shoulders of a normal, average size man so that the arms of the person lifting said bag by two adjacent longitudinally separated handles, are essentially parallel.

2. The bag of claim 1, wherein each handle of said plurality of handles includes a first end, a second end and a handle body, said handle body defining a handle grasping section, said first end and said second end secured to said bag body and separated a distance defined by said handle body, said handle body being spaced from said bag body and adapted to receive the hand of a person.

* * * * *